United States Patent [19]

Hedlund

[11] Patent Number: 4,733,915

[45] Date of Patent: Mar. 29, 1988

[54] DEVICE FOR SUPPLYING FLUID AT TOOLS FOR BREAKING SOLID MATERIAL

[75] Inventor: Jan-Gunnar Hedlund, Sandviken, Sweden

[73] Assignee: Santrade Limited, Lucerne, Switzerland

[21] Appl. No.: 859,022

[22] Filed: May 2, 1986

[30] Foreign Application Priority Data

May 3, 1985 [SE] Sweden ..... 8502160

[51] Int. Cl.[4] ..... E21C 35/22; E21C 25/12

[52] U.S. Cl. ..... 299/81; 299/1

[58] Field of Search ..... 299/81, 85, 17, 12, 299/1

[56] References Cited

U.S. PATENT DOCUMENTS

| | | | |
|---|---|---|---|
| 3,988,578 | 10/1976 | Weber | 299/1 X |
| 4,143,552 | 3/1979 | Godfrey | 299/1 X |
| 4,189,183 | 2/1980 | Borowski | 299/1 |
| 4,488,759 | 12/1984 | Bergqvist | 299/81 |
| 4,534,597 | 8/1985 | Kemper | 299/81 |

FOREIGN PATENT DOCUMENTS

| | | | |
|---|---|---|---|
| 010534 | 4/1980 | European Pat. Off. . | |
| 2854307 | 7/1980 | Fed. Rep. of Germany . | |
| 3122323 | 12/1982 | Fed. Rep. of Germany | 299/81 |
| 2036127 | 12/1978 | United Kingdom | 299/81 |
| 2070104 | 9/1981 | United Kingdom | 299/81 |
| 0610993 | 6/1978 | U.S.S.R. | 299/81 |

*Primary Examiner*—Stephen J. Novosad
*Assistant Examiner*—David J. Bagnell
*Attorney, Agent, or Firm*—Burns, Doane, Swecker & Mathis

[57] ABSTRACT

A device for supplying fluid at a socket for axial not displaceably mounted tools for breaking of solid material, fluid is arranged to be supplied to a nozzle adjacent to the tool when a working tool is subjected to a counteracting force.

9 Claims, 2 Drawing Figures

DEVICE FOR SUPPLYING FLUID AT TOOLS FOR BREAKING SOLID MATERIAL

BACKGROUND OF THE INVENTION

The present invention relates to a device for supplying fluid to tools mounted in sockets in such a way that they are not axially movable, said tools being used to break solid materials, e.g., coal, and that a nozzle is arranged adjacent to the tool, said nozzle being related to a control valve that is arranged to supply fluid to the nozzle when a working tool is subjected to a counteracting force. In devices of that kind fluid is supplied in order to cool the tool and the rock and thus decrease the risk for sparking, that can cause ignition or gas explosion. The fluid is also supplied in order to restrain the presence of dust. High fluid pressure can also assist in breaking the material. In order to restrict the amount of supplied fluid the devices are arranged in such a way that fluid is supplied only when a working tool is charged axially. Devices of that kind are previously known from German Pat. Nos. 28 54 307, No. 33 07 895, and European Application No. 10 534.

In these known devices the tool is arranged to be displaced rearwardly in an axial direction during work, said axial displacement being used to control the fluid supply to the nozzle.

An aim of the present invention is to design the device in such a way that the counteracting force on the tool can be used for control of the fluid supply without requiring an axial displacement of the tool in the socket.

THE DRAWINGS

The invention is described in detail in the following with reference to the accompanying drawings in which one embodiment is shown by way of example. It is to be understood that this embodiment is only illustrative of the invention and that various modifications may be made within the scope of the claims.

FIG. 1 discloses a socket having a tool that is connected to a device according to the invention.

FIG. 2 illustrates how the forces acting on the tool control the supply of fluid to the nozzle.

DESCRIPTION OF A PREFERRED EMBODIMENT OF THE INVENTION

Figure 1:
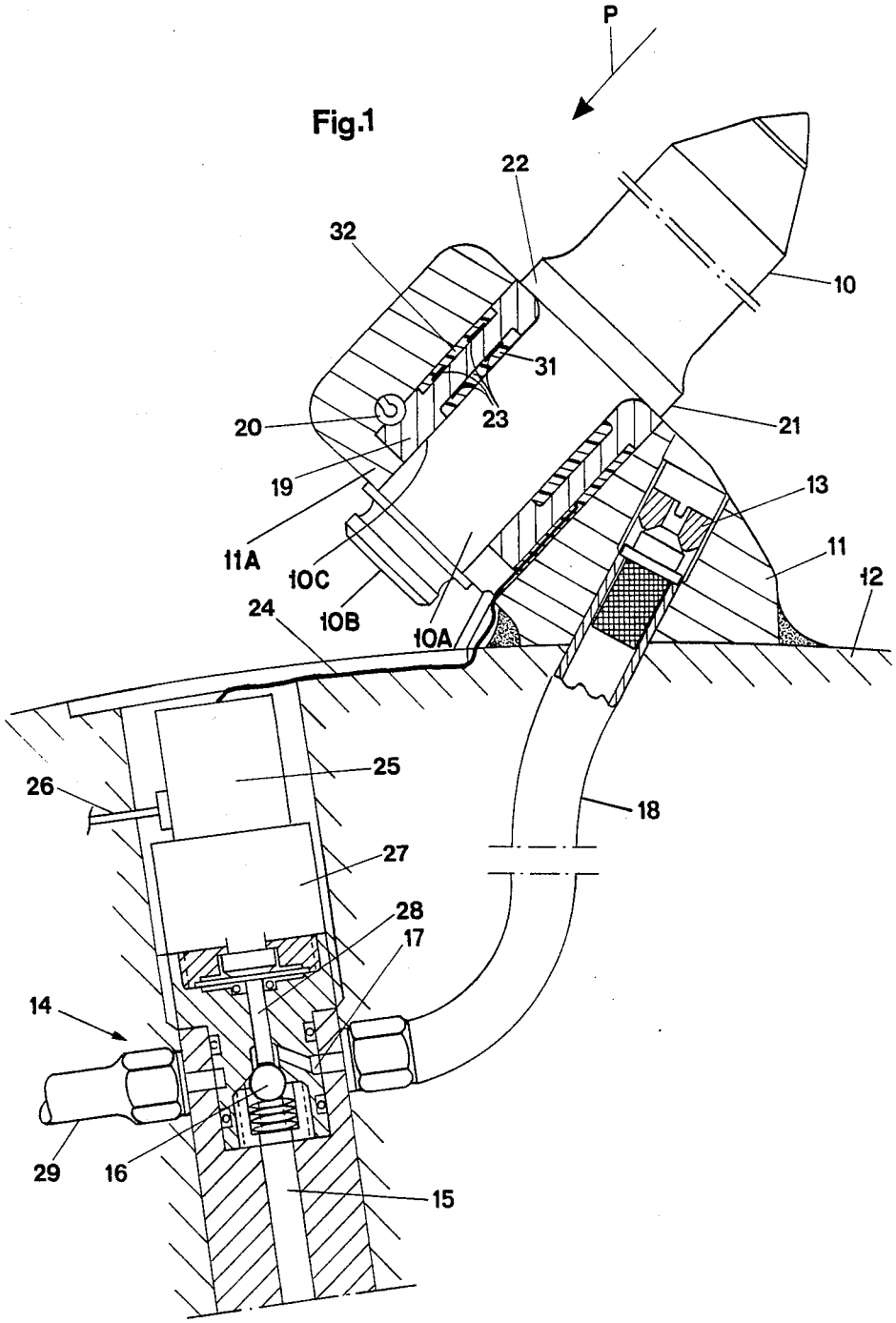
Figure 2:
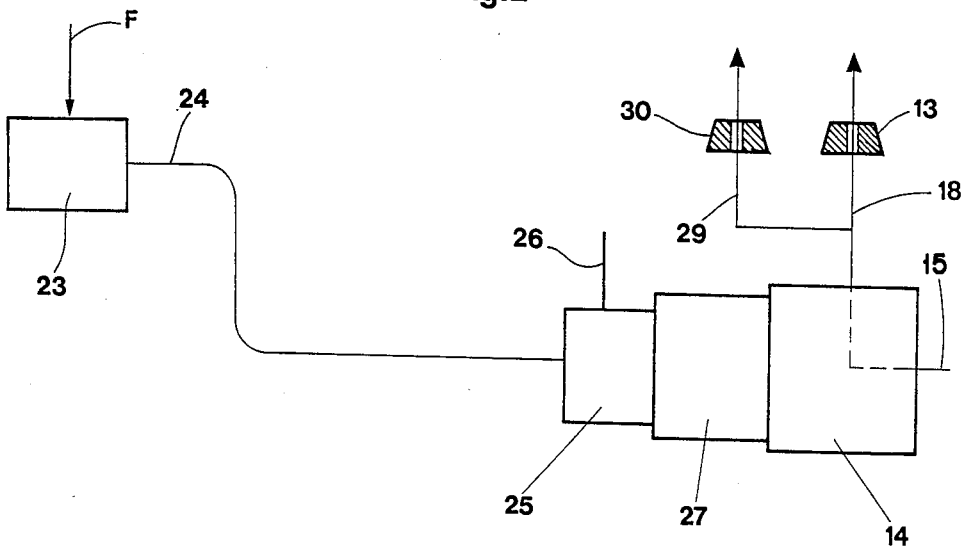

In the disclosed embodiment a tool 10 for breaking solid material, e.g., coal, is mounted in a socket 11. The socket 11 is welded to a tool carrier portion 12 of a machine for breaking solid materials, e.g., a cutting head or a cutting roller. Adjacent the tool 10 is a nozzle 13 arranged in the socket 11. The nozzle 13 has such a direction that a fluid jet discharged from the nozzle is directed somewhat in front of the tip of the tool 10.

The nozzle 13 is connected to a control valve 14, that via a boring 15 in the valve is in connection with a not shown fluid source. When actuating a valve body 16 in the control valve 14, in a way that will be described below, fluid flows under high pressure from the boring 15, passes the valve body 16 and enters an annular space 17 in the control valve 16. From that space the fluid flows to the nozzle 13 via a boring 18.

The tool 10 includes a cylindrical shank 10A which is rotatably mounted in a sleeve 19, that via a locking pin 20 is secured in the socket 11. The tool 10 is also arranged, via a flange 21, to bear against the frontal end surface 22 of the sleeve 19. The sleeve 19 bears rearwardly against a rear wall 11A of the socket 11. Thus, the tool 10 is constrained against rearward retraction relative to the tool carrier 12.

During work the tool 10 is subjected to a rearwardly directed force F in the direction of the arrow P. Said force generates a compression strain in the sleeve 19. Sensor means in the shape of strain gauges 23 are secured to the sleeve 19 in such a way that they generate a control signal when a compression strain is present in the sleeve 19. The strain gauges are disposed forwardly of a rear end 10B of the shank so as to engage a front-to-rear extending cylindrical outer periphery 10C of the shank. The control signal is via a cable 24 transmitted to an amplifier 25, that via a wire 26 is connected to a voltage source (not shown). The amplified control signal from the amplifier is transmitted to an electromagnet 27, that displaces an operating rod 28 that is in engagement with the valve body 16, said displacement causing the valve body 16 to raise from its seat. The sensor means 23 of the control valve 14 is thus arranged to generate, in respect of the force F, pulses that open the control valve 14. The strain gauges 23 are arranged in an interior and an exterior recess in the sleeve 19. Said recesses are filled with e.g., a rubber material 31 and 32 respectively to protect the gauges. Due to the fact that the tool is not axially movable in the socket said tool always bears against the socket. This prevents particles from entering between the tool and socket and negatively affecting the rotating of the tool. The rotating is important in order to have a uniform wearing of the tool tip.

If it is deemed favorable each of the nozzles 13 can have its own control valve 14. However, it seems more convenient to arrange the nozzles 13 in groups and give each group a control valve 14. This alternative is from an economic point of view favorable due to the fact that fewer control valves and sensor means are required. Said alternative is illustrated in the figures showing fluid flowing from the space 17 via the borings 18, 29 to the nozzles 13, 30, said nozzle 30 being arranged in attachment to a tool (not shown).

In a system described above a certain delayed action can be expected. This means that the tool 10 already has started to work when the fluid supply to its nozzle starts.

In order to eliminate the effect of this delayed action the control valve 14 of those sensor means 23 that sense the force F acting on a first tool 10 can be arranged to supply fluid to a second tool that is subsequent the first tool in the working order. When the control valve 14 is shut there is a time delay because of damping so that the subsequent tool has time to leave its engagement with the material before the fluid supply to the last-mentioned tool is shut off.

Although the invention is disclosed in connection with rotatably mounted tools it can of course be used for non-rotatably mounted tools. Also the nozzles, instead of in front of the tool as is shown in FIG. 1, can be arranged behind the tool or both behind and in front of the tool. In the last-mentioned case the fluid preferably flows from the space 17 in FIG. 1 to the frontal nozzle via the boring 18 and to the rear nozzle via the boring 29.

I claim:

1. Apparatus for breaking solid materials comprising a movable tool carrier, a cutting tool mounted on said tool carrier, said tool being moved forwardly into cutting relationship with said solid materials in response to forward movement of said carrier, means constraining said tool against rearward retraction relative to said carrier, a nozzle carried by said tool carrier and oriented to eject fluid toward a cutting zone of said cutting tool, a fluid conduit for supplying fluid to said nozzle, valve means arranged to selectively open and close said fluid line, valve control means comprising a strain gauge sensor arranged to sense compression strain of said tool during a cutting operation, and means operatively connected to said strain gauge sensor and said valve means for opening said valve means to supply fluid to said nozzle in response to said strain gauge sensor sensing a compression strain in said tool.

2. Apparatus according to claim 1 including a socket immovably affixed to said carrier, said tool being mounted in said socket.

3. Apparatus according to claim 2, wherein said tool is rotatable about a longitudinal axis of said socket.

4. Apparatus according to claim 2 including a sleeve mounted in said socket externally of said tool, said strain gauges mounted on said sleeve.

5. Apparatus according to claim 4, wherein said sleeve includes a frontal end surface, said tool including a shank disposed in said sleeve and a flange disposed outside of said sleeve and bearing against said frontal end surface.

6. Apparatus according to claim 1, there being a plurality of said tools, a nozzle for each tool, and a separate said valve means for each nozzle.

7. Apparatus according to claim 1, there being a plurality of said tools and a nozzle for each tool, said valve means being connected to a plurality of said nozzles.

8. Apparatus according to claim 1 including an additional tool on said carrier, said additional tool arranged to follow said first-named tool, said sensor arranged to sense the compression strain of said first-named tool and direct fluid toward said additional tool.

9. Apparatus according to claim 2, wherein said cutting tool includes a cylindrical shank disposed in said socket, said strain gauge sensor positioned in said socket forwardly of a rear end of said shank so as to engage a front-to-rear extending outer periphery of said shank.

* * * * *